United States Patent [19]

Shimizu et al.

[11] Patent Number: 4,767,663

[45] Date of Patent: Aug. 30, 1988

[54] HEAT-MELTABLE TRANSFER RECORDING MEDIUM

[75] Inventors: Suekichi Shimizu, Takatsuki; Masatsugu Inaba, Settsu; Yasuyuki Ohtomo, Suita, all of Japan

[73] Assignee: Fuji Kagakushi Kogyo Co., Ltd., Osaka, Japan

[21] Appl. No.: 931,466

[22] PCT Filed: Feb. 13, 1986

[86] PCT No.: PCT/JP86/00067

§ 371 Date: Oct. 14, 1986

§ 102(e) Date: Oct. 14, 1986

[87] PCT Pub. No.: WO86/04859

PCT Pub. Date: Aug. 28, 1986

[30] Foreign Application Priority Data

Feb. 15, 1985 [JP] Japan ..... 60-28931

[51] Int. Cl.[4] ..... B41M 5/025; B41M 5/26

[52] U.S. Cl. ..... 428/212; 428/195; 428/317.3; 428/317.7; 428/318.4; 428/319.3; 428/319.7; 428/319.9; 428/484; 428/488.4

[58] Field of Search ..... 428/195, 484, 488.1, 428/488.4, 913, 914, 212, 317.1, 317.3, 317.7, 318.4, 319.3, 319.7, 319.9

[56] References Cited

U.S. PATENT DOCUMENTS 4,617,244 10/1986 Hotta et al. ..... 428/195

FOREIGN PATENT DOCUMENTS 0042954 1/1982 European Pat. Off. .

114098 6/1984 Japan ..... 428/212

*Primary Examiner*—John E. Kittle

*Assistant Examiner*—P. R. Schwartz

*Attorney, Agent, or Firm*—Armstrong, Nikaido, Marmelstein & Kubovcik

[57] ABSTRACT

A heat-meltable transfer recording medium comprising a foundation and a transferable ink layer provided on the surface of the foundation, said transferable ink layer comprising a colored layer containing a coloring agent and a heat-meltable adhesive layer provided on the surface of the colored layer, said heat-meltable adhesive layer comprising at least one of a resin and a wax, each of which is solid at ordinary temperatures and softened or melted upon heating with a heating head, and said colored layer having a viscosity of not less than $8\times10^2$ poises at 110° C. (measurement with a rotary viscometer) or being semi-solid or solid at 110° C., in order to produce an image which is fast at a normal state but is readily removed by peeling off when being heated.

1 Claim, No Drawings

HEAT-MELTABLE TRANSFER RECORDING MEDIUM

TECHNICAL FIELD

The present invention relates to a heat-meltable transfer recording medium which is used to produce printed images on a plain paper by means of a thermal recording apparatus provided with a thermal print head, a laser print head or an electrothermal print head.

BACKGROUND ART

In the case of producing printed images using a heat-meltable transfer recording medium of this type, heretofore, printed images were produced on a plain paper by selectively heating and softening a transferable ink layer provided on the surface of a foundation by means of a heating means such as thermal head to transfer the ink layer to the plain paper. The thus produced images were not readily removed by peeling off them.

In recent years, however, a function of correcting erroneous images has been required with wide use of this heat-meltable transfer system and it is desired to improve a removability of image.

Under the circumstances, Japanese Patent Unexamined Publication No. 57-22090 proposes to provide a penetration-depressing layer on the surface of a heat-meltable ink layer to depress the penetration of a heat-meltable ink into a recording paper.

However, the above-mentioned recording medium has a drawback that an image formed on a recording paper can easily be rubbed off with a finger, and other drawbacks, which cause a problem that a fastness of image which is an advantage inherent in the hot-meltable transfer system is remarkably reduced, and other problems.

An object of the present invention is to provide a heat-meltable transfer recording medium capable of producing on a recording paper an image which is readily removed by peeling it off from the paper when being heated but is good in fastness in a normal state without disadvantages such as an image being rubbed off.

DISCLOSURE OF THE INVENTION

The present invention provides a heat-meltable transfer recording medium comprising a foundation and a transferable ink layer provided on the surface of the foundation, said transferable ink layer comprising a colored layer containing a coloring agent and a heat-meltable adhesive layer provided on the surface of the colored layer, said heat-meltable adhesive layer comprising at least one of a resin and a wax, each of which is solid at ordinary temperatures and softened or melted when being heated with a heating head, and said colored layer having a viscosity of not less than $8\times10^2$ poises at 110° C. (measurement with a rotary viscometer) or being semi-solid or solid at 110° C.

Herein the term "semi-solid" means a highly viscous state which exceeds the measurable limit of a rotary viscometer.

In the case of printing using the recording medium of the present invention, the colored layer ovelies the heat-meltable adhesive layer with respect to an image after being transferred onto a recording paper. The colored layer is noticeably highly viscous. For the reasons, the image is not broken or removed by rubbing it with finger, etc. By the self-lift-off method mentioned later or a method wherein the above-mentioned image is heated with a heating means such as heating head while interposing between the image and the heating means a lift-off means such as film assuming an adhesiveness against the colored layer upon heating or an adhesive tape, the above-mentioned colored layer is completely separated from the heat-meltable adhesive layer and peeled off.

As a result, an image once formed on a recording paper can be readily removed by peeling off with a lift-off means when the image is heated with a heating means such as heating head. However, the image on the recording paper is hardly broken or removed unless being heated, and consequently it has a fastness.

The recording medium of the present invention will be explained in detail.

The colored layer is formed by dispersing and mixing a coloring agent and, if necessary, a filler and a plasticizer, into a vehicle, dispersing and mixing the mixture into a volatile solvent, and applying the resulting mixture onto a foundation so that the coating amount after being dried is 0.2 to 10 g/m$^2$, preferably 1 to 6 g/m$^2$, followed by drying.

A material having a melting or softening temperature within the range of 50° to 250° C. is preferably used as the above-mentioned vehicle. Examples of such vehicles include vinyl resins such as polyvinyl chloride and polyvinyl acetate; vinyl copolymer resins such as vinyl chloride-vinyl acetate copolymer; cellulosic resins such as ethyl cellulose and cellulose acetate; other thermoplastic resins such as polyethylene, polystyrene, polypropylene, polyester and polyamide, and rubbers such as synthetic rubber, chlorinated rubber and natural rubber. Other materials, if they are capable of being softened by heat but hard to be melted or they are melted but give a melt having a high viscosity, can be appropriately used. Those vehicles may be used singly or as a combination of two or more kinds thereof.

As the above-mentioned coloring agent, there can be appropriately used inorganic or organic pigments or dyes which are heretofore known as a coloring agent for a heat-meltable transfer ink, and magenetic powders or metal powders, fluorescent pigments or dyes, and the like. The coloring agent is preferably used in an amount 0.5 to 4.8 parts by weight when the total amount of the colored layer is taken to be 5 parts by weight.

Body pigments such as calcium carbonate, silica, clay and diatomaceous earth can be suitably used as the aove-mentioned filler. When the filler is used, the amount thereof is preferably from 0.5 to 4.5 parts by weight when the total amount of the colored layer is taken to be 5 parts by weight.

Di(2-ethylhexyl)phthalate, di(2-ethylhexyl)azelate, mineral oils, vegetable oils, animal oils, etc. can be suitably used as the above-mentioned plasticizer. When the plasticizer is used, the amount thereof is preferably from 0.05 to 1.5 parts by weight when the total amount of the colored layer is taken to be 5 parts by weight.

The mixing proportion of the above-mentioned components of the colored layer is suitably determined so that a proper viscosity difference is provided between the colored layer and the heat-meltable adhesive layer provided thereon.

It is necessary that the colored layer has a viscosity of not less than $8\times10^2$ poises at 110° C. (measurement with a rotary viscometer, hereinafter the same) or is semi-solid or solid at 110° C. When the viscosity of the colored layer at 110° C. is less than $8\times10^2$ poises, a part of the colored layer of an image remains together with the heat-meltable adhesive layer when peeling off and removing the image, which results in an impossibility of completely removing the image.

Further, the colored layer is changed to a network structure having minute pores due to the above-mentioned high viscosity of the colored layer when being heated. A part of the adhesive layer which has a low viscosity is penetrated between the foundation and the colored layer through the network, which provides an advantage that the colored layer is readily separated from the foundation and the transfer of the colored layer onto a recording paper is more completely accomplished.

When a method where an image on a recording paper is peeled off by overlaying a recording medium in accordance with the invention onto the image on the recording paper and applying again heat thereto, whereby bonding the colored layer of the image to that recording medium (hereinafter referred to as "self-lift-off method") is used for removing an image, the network formed in the image absorbs a material of the adhesive layer, on the recording medium side, which is melted by heating, so that the colored layer of the image is directly adhered to the high-viscous colored layer on the recording medium side to increase a bonding strength between both colored layers, which ensures a secure peeling-off.

The heat-meltable adhesive layer is formed on the colored layer so that the coating amount thereof is from 1 to 7 g/m$^2$. The material constituting the adhesive layer is a resin and/or a wax, which are melted or softened at 50° to 200° C. Examples of such material include natural waxes such as carnauba wax and beeswax, petroleum waxes such as paraffin wax and microcrystalline wax, synthetic waxes such as polyethylene wax, a variety of fatty acids and a variety of fatty acid amides. Further, a variety of resins which are used as a vehicle for the above-mentioned colored layer can be used. However, the exactly same formulation as that of the vehicle of the colored layer must be avoided. Those materials may be used singly or as a combination of two or more kinds thereof.

When the above-mentioned heat-meltable adhesive layer is composed of a wax as a main component, a resin or a rubber may be appropriately incorporated thereinto to improve an adhesiveness against a recording paper or adjust an adhesiveness against the colored layer. When such resin or rubber is used, it is added in an amount of 0.01 to 4.5 parts by weight when the total amount of the heat-meltable adhesive layer is taken to be 10 parts by weight. As such resin or rubber, there are suitably selected one or more members among petroleum resin, hydrocarbon resin, polyethylene resin, ethylene-vinyl acetate copolymer, rosin, butadiene rubber, and the like.

The adhesive layer is solid at ordinary temperatures. However, it is preferably that the viscosity of the adhesive layer at 110° C. is lower than that of the colored layer by 0.1 poise or more, more suitably by 1 poise or more. By providing such viscosity difference between the adhesive layer and the colored layer, the colored layer of an image is easily separated from the adhesive layer when removing the image, which results in an easiness of removing the image.

As the foundation, there can be suitably used plastic films having a thickness of 1 to 20$\mu$, such as polyester film, polycarbonate film, polysulfone film, fluorine-containing resin film and polyimide film, papers having a thickness of 5 to 50$\mu$, such as condenser paper, india paper and glassine paper, and cellophane having a thickness of 5 to 50$\mu$.

In order to exhibit more favorably the effect of the invention, it is preferable that the vehicle of the colored layer and the vehicle of the adhesive layer are incompatible or hardly compatible to each other. The reason therefor is that when a transferable ink layer is formed, a clear interface is formed between the colored layer and the adhesive layer and a coloring agent of the colored layer is not mixed in the adhesive layer. When a great viscosity difference is provided between both layers, it is not necessarily required that the vehicles of both layers are incompatible or hardly compatible to each other.

BEST MODE FOR CARRYING OUT THE INVENTION

The present invention will be explained by referring to Examples. In the following Examples, a rotary viscometer used is Rotovisco RV12 made by Haake Mess-Technik GmbH in W. Germany. The revolution of the rotor thereof for measurement is 1 rpm.

EXAMPLE 1

The following ink A was applied onto a polyester film having a thickness of 9$\mu$ so that a coating amount after being dried was 4 g/m$^2$ and dried.

| [Ink A (semi-solid at 110° C.)] | |
|---|---|
| Vinylite VYHH (softening temperature: 76° C.) (commercial name of vinyl chloride-vinyl acetate copolymer made by Union Carbide Corp.) | 4 parts by weight |
| Carbon black | 1 part by weight |
| Calcium carbonate | 2 parts by weight |
| Methyl ethyl ketone | 13 parts by weight |

After a black colored layer was thus formed, the following ink B was applied onto the surface of the colored layer in a coating amount of 3 g/m$^2$ by hot-melt coating.

| [Ink B (viscosity at 110° C. with the rotary viscometer: 0.5 poise)] | |
|---|---|
| Carnauba wax (melting temperature: 83° C.) | 3 parts by weight |
| Paraffin wax (melting temperature: 72° C.) | 6 parts by weight |
| Ethylene-vinyl acetate copolymer (melting temperature: 72° C.) | 1 part by weight |

Thus a heat-meltable adhesive layer was formed on the surface of the colored layer.

The thus obtained recording medium was mounted in a serial printer made by Canon Inc. (Typestar 5). The ink layer of the recording medium was selectively melted and transferred to a plain paper by pressing and heating the recording medium with a thermal head from the back surface side of the foundation, giving images.

The formed images had the same clearness and density as those obtained by using a conventional heat-meltable transfer recording medium.

Next, an ink layer of an unused area of the recording medium was overlaid on the image and the ink layer was again pressed and heated in the printer with the thermal head which was heated to a considerably higher temperature than that employed when printing. As a result, the colored layer of the image was completely transferred to the recording medium side and it was only a part of the heat-meltable adhesive layer that remained on the recording paper. Thus it was impossible to read out the image.

When another image was again formed onto a trace where the image was removed by using the recording medium, there could be formed an image having the same density and clearness as those obtained with the initial printing and wherein no void and blur occurred.

When the recording medium was overlaid on the above-obtained image on the recording paper and only pressed, a part of the colored layer of the image remained on the recording paper, which resulted in failure of the complete removal of the image.

When the above-obtained image was rubbed with a finger, the colored layer of the image was not broken or removed.

As a lift-off element for removing an image, there can be used, in addition to the above-mentioned, "lift-off heat-sensitive correction element" shown in Japanese Patent Unexamined Publication No. 57-98367; an element produced by applying and drying a usual hot-melt adhesive in a small thickness on a foundation as mentioned above and making the resultant into tapes; an element produced by applying a polyethylene resin in a small thickness on a foundation as mentioned above; an element produced by laminating a polyethylene film and a polyester film; or films or high density papers having a smooth surface. Those elements has a function of peeling off the colored layer of an image when being heated with a thermal head, which function is the same as that of the above-mentioned element.

EXAMPLE 2

The following ink C was applied onto a polyester film having a thickness of 9$\mu$ so that a coating amount after being dried was 4 g/m$^2$ and dried.

| [Ink C (viscosity at 110° C. with the rotary viscometer with respect to the ink after being dried: 900 poises)] | |
|---|---|
| DPX550 (softening temperature: 105° C.) (commercial name of a polyamide resin made by Henkel GmbH.) | 1 part by weight |
| Carbon black | 5 parts by weight |
| Toluene | 8 parts by weight |
| Isopropyl alcohol | 8 parts by weight |

After a black colored layer was thus formed, the ink B as used in Example 1 was applied onto the surface of the colored layer in a coating amount of 3 g/m$^2$ by hot-melt coating.

Employing the thus obtained recording medium, tests for printing property, removability of image, etc, were carried out in the same manner as in Example 1. As a result, the same good results as in Example 1 were obtained.

EXAMPLE 3

The ink C as used in Example 2 was applied onto a condenser paper having a thickness of 13$\mu$ so that a coating amount after being dried was 4 g/m$^2$ and dried.

After a black colored layer was thus formed, the following ink D was applied on the surface of the colored layer in a coating amount of 3 g/m$^2$ by hot-melt coating.

| [Ink D (viscosity at 140° C. with the rotary viscometer: 7 poises, semi-solid at 110° C.)] | |
|---|---|
| Hiwax 400P (melting temperature: 132° C.) (commercial name of a polyethylene wax made by Mitsui Petrochemical Industires, Ltd.) | 9 parts by weight |
| Arkon M-100 (melting temperature: 100° C.) (commercial name of a petroleum resin made by Arakawa Kagaku Kogyo Kabushiki Kaisha) | 1 part by weight |

Employing the thus obtained recording medium, tests for printing property, removability of image, etc, were carried out in the same manner as in Example 1. As a result, the same good results as in Example 1 were obtained.

We claim:

1. A heat-meltable transfer recording medium comprising a foundation and a transferable ink layer provided on the surface of the foundation, said transferable ink layer comprising a colored layer containing a coloring agent and a vehicle, and a heat-meltable adhesive layer containing no coloring agent provided on the surface of the colored layer, said colored layer having a viscosity of not less than $8\times10^2$ poises at 110° C. when measured with a rotary viscometer or being semi-solid or solid at 110° C. and being capable of forming a network structure having minute pores when heated for printing or lift-off of an image, the vehicle of said adhesive layer comprising a resin and as its main component a wax, each of which is solid at ordinary temperatures and softened or melted upon heating with a heating head, the resin being present in an amount of 0.01 to 4.5 parts by weight per 10 parts by weight of said adhesive layer, the vehicle of said adhesive layer and that of said colored layer being incompatible or hardly compatible with each other, and the viscosity of said adhesive layer at 110° C. being lower than that of said colored layer by 0.1 poise or more.

* * * * *